US005449333A

United States Patent [19]

Carter

[11] Patent Number: 5,449,333

[45] Date of Patent: Sep. 12, 1995

[54] BAR HAVING O-RINGS TO SECURE THE WEIGHT

[75] Inventor: Steven B. Carter, Bradenton, Fla.

[73] Assignee: L³Enterprises, Inc., Parrish, Fla.

[21] Appl. No.: 300,151

[22] Filed: Sep. 1, 1994

[51] Int. Cl.[6] ..... A63B 21/075

[52] U.S. Cl. ..... 982/109; 482/107

[58] Field of Search ..... 482/50, 93, 106–109; 273/193 A, 194 B

[56] References Cited

U.S. PATENT DOCUMENTS

| | | | |
|---|---|---|---|
| 2,470,816 | 3/1948 | Harvey | 482/109 |
| 4,312,506 | 1/1982 | Brennan . | |
| 4,411,423 | 10/1983 | Estwanik . | |
| 4,634,121 | 1/1987 | Sasaki | 482/109 |
| 4,773,641 | 9/1988 | Metz | 482/107 |
| 4,869,491 | 9/1989 | Nolan . | |
| 5,060,933 | 10/1991 | Cedro . | |

*Primary Examiner*—Richard J. Apley
*Assistant Examiner*—John Mulcahy
*Attorney, Agent, or Firm*—Charles J. Prescott

[57] ABSTRACT

A weight exercise device for strengthening wrists, arms and shoulders and related muscles. The device includes an elongated cylindrical weight bar having evenly spaced annular grooves formed into its outer surface extending from one end of the weight bar up to a gripping area thereof. The gripping area is preferably defined by an elastomeric foam sleeve secured on the weight bar extending from the other end toward the center area of the weight bar. The device also includes several cylindrical weights of equal length and different weight size each longitudinally bored therethrough for sliding engagement on the weight bar over the grooves. Each weight is held separately or collectively as desired, both with respect to longitudinal positioning and sequence of arrangement on the weight bar by an elastic O-ring fitted into the groove at each end of the weight(s). A beveled shoulder formed at the end of each longitudinal bore facilitates easy removal of the O-rings from the grooves, even through the groove spacing is such that the positioned O-rings prevent axial movement or rattling the weights during use of the device.

8 Claims, 2 Drawing Sheets

Fig. 1
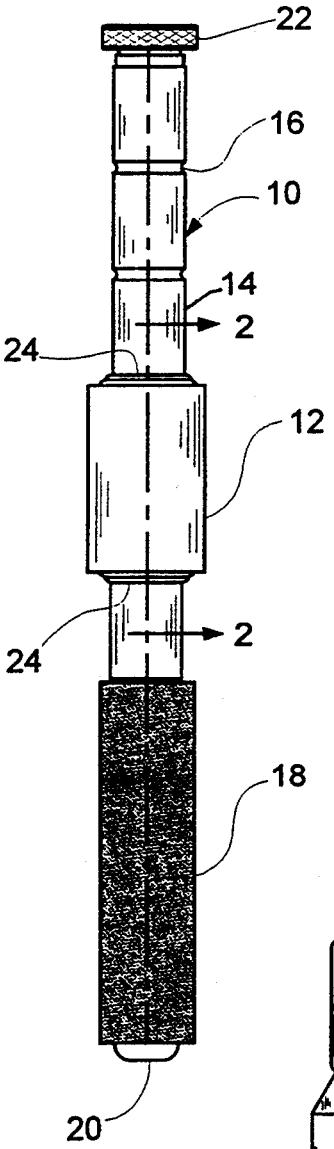
Fig. 2
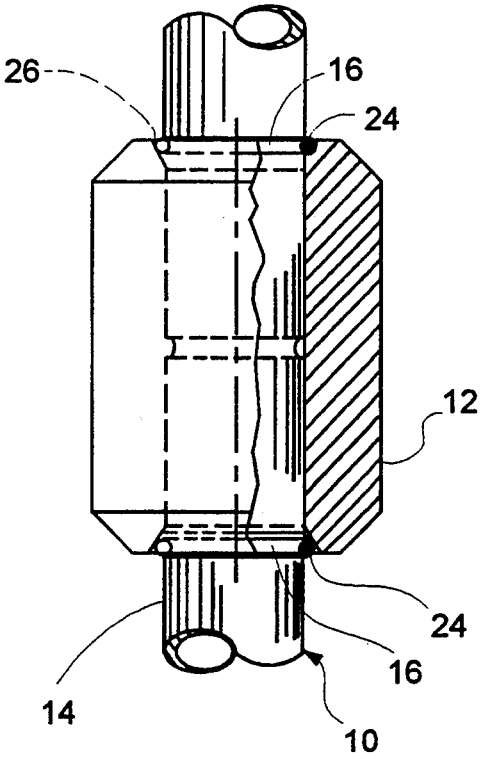
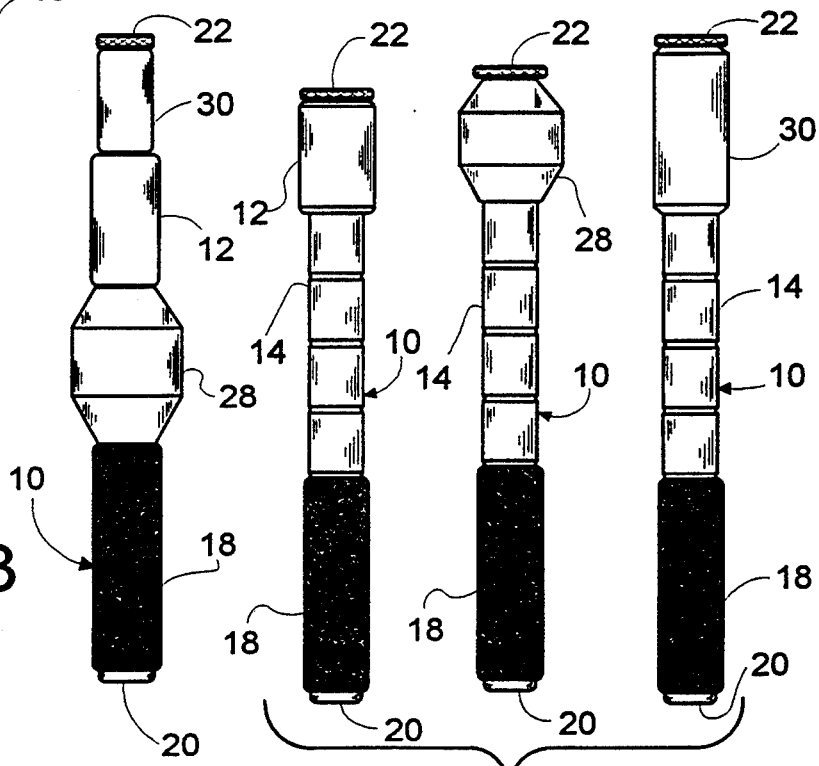
Fig. 3
Fig. 4

BAR HAVING O-RINGS TO SECURE THE WEIGHT

BACKGROUND OF THE INVENTION

1. Scope of Invention

This invention relates generally to exercise devices, and more particularly to a variable weight exercise device for exercising wrists, arms, shoulders and related muscles.

2. Prior Art

An endless range of exercise devices for strengthening muscles of the human anatomy are well known. One general class of such exercise devices includes those which provide a weight which is movable in some fashion to provide a resistive force to muscle movement.

One such device is disclosed in U.S. Pat. No. 5,060,933 invented by Cedro which teaches a wrist stick multi-function exercise device usable in combination with a weight on the end of a rope which exercises the wrists and forearms as the rope is raised by rotation of the stick. The device is also useful by grasping at one end thereof for exercising some of the arm and shoulder muscles.

An early U.S. Pat. No. 2,470,816 by Harvey also discloses a weight exercising device which includes two spaced grips or sleeves positioned on an elongated cylindrical shaft and having a movable weight securable along the length of the remainder of the shaft by clamping means.

Another wrist and arm exercise device is disclosed by Estwanik in U.S. Pat. No. 4,411,423 teaching an exercise adapter connectable onto the grip of a tennis racket and utilizing a duffle bag or the like connectable at the end of a flexible rope, the duffle bag being lifted by rotation of the tennis racket by the user.

Applicant is also aware of a bicep exercising curling bar disclosed in U.S. Pat. No. 4,312,506 by Brennan. This reference teaches the use of a cushioned weight-distributing plate having a hand grip rod laterally offset from a pair of weight-supporting rods which avoid pronation of the wrists.

In U.S. Pat. No. 4,869,491, Nolan teaches an exercise device for strengthening the wrists which includes a pair of non-aligned hand grips rotatably mounted on a non-linear bar and spring biased to resist rotation of the hand grips.

A French Patent No. 1031855 presented by Corbin, according to the drawings, teaches a conventional bar bell having movable weights at each end positioned along the bar bell through the use of either a set screw or ball detent arrangement.

The present invention provides a weight exercise device having a cushioned grip at one end of an elongated cylindrical weight bar and a plurality of variously sized weights which slidably engage onto the weight bar and are held in the desired position and arrangement by O-rings at each end of one or more of the weights in sequence within spaced grooves formed along the length of the weight bar.

BRIEF SUMMARY OF THE INVENTION

This invention is directed to a weight exercise device for strengthening wrists, arms and shoulders and related muscles. The device includes an elongated cylindrical weight bar having evenly spaced annular grooves formed into its outer surface extending from one end of the weight bar up to a gripping area thereof. The gripping area is preferably defined by an elastomeric foam sleeve secured on the weight bar and extending from the other end toward the center area of the weight bar. The device also includes several cylindrical weights of equal length and different weight size each longitudinally bored therethrough for sliding engagement on the weight bar over the grooves. Each weight is held separately or collectively end-to-end as desired, both with respect to longitudinal positioning and sequence of arrangement on the weight bar by an elastic O-ring fitted into the groove at each end of the weight(s). A beveled shoulder formed at the end of each longitudinal bore facilitates easy removal of the O-rings from the grooves, even though the groove spacing is such that the positioned O-rings prevent axial movement or rattling the weights during use of the device.

It is therefore an object of this invention to provide a weight exercise device uniquely structured for exercising the wrists, arms, shoulders and the muscles related thereto.

It is yet another object of this invention to provide a weight exercise device usable in a wide variety or arm and wrist motions.

It is yet another object of this invention to provide a weight exercise device for exercising wrists, arms, shoulders and the muscles related thereto having a very broad range of weight-resisting elements and placement thereof.

In accordance with these and other objects which will become apparent hereinafter, the instant invention will now be described with reference to the accompanying drawings.

BRIEF DESCRIPTION OF THE DRAWINGS

FIG. 1 is an elevation view of the invention.

FIG. 2 is a section view in the direction of arrows 2—2 in FIG. 1.

FIG. 3 is a perspective elevation view of the invention in either a stored configuration or having all of the removable weights fully in position for use.

FIG. 4 is an elevation view of the invention in three separate configurations.

DETAILED DESCRIPTION OF THE INVENTION

Figure 5:
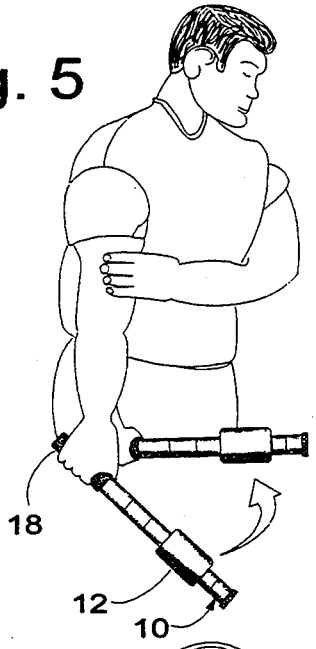
FIG. 5 is a perspective view of the invention shown in FIG. 1 in use for radial deviation.

Referring now to the drawings, the invention includes a weight bar shown generally at numeral 10 and a plurality of cylindrical weights 12, 28 and 30, each of equal overall length and having a cylindrical longitudinal bore formed therethrough sized to allow the weights 12, 28 and 30 to be slidably engageable onto tubular shaft 14 of the weight bar 10.

Tubular shaft 14 of the weight bar 10 includes a plurality of evenly spaced grooves 16 formed therealong starting from one end thereof into which a threaded stop 22 is also engaged. These grooves 16 are spaced apart in equal distances so that the length of each of the weights 12, 28 and 30 are in multiples of that groove spacing.

Disposed from the other end of tubular shaft 14 is a compressible foam sleeve 18 defining a gripping area of the device 10. This compressible elastomeric sleeve 18 is permanently secured onto tubular shaft 14, the open end thereof being closed and finished off by a plastic end cap 20. The knurled threaded stop 22 is provided so that, once one or more of the weights 12, 28 and 30 are positioned onto tubular shaft 14, they will not inadvertently slide therefrom.

To secure either the individual weights 12, 28 or 30 as seen in FIG. 2 or to secure any other useful combination of weights 12, 28 and/or 30 onto the tubular shaft 14, an elastomeric O-ring is fitted into the appropriate aligned groove 16 at each end of the weight 12 (typ.) in FIG. 2. As will be appreciated, by providing the groove spacing as shown or in other multiples of the overall length of each of the weights 12, 28 and 30, a broad range of resistive weight and cantilever movement with respect to the gripping area for exercising is achievable.

To ensure that the weights 12, 28 and 30 are not allowed to move along tubular shaft 14 once secured by O-rings 24 as seen in FIG. 2, each end of the longitudinal bore through each of the weights 12, 28 and 30 is beveled at 26 (typ.). This beveled structure also facilitates easy disengagement of the O-ring 24 when a weight adjustment is desired. The user simply twists or rotates the weight 12, 28, or 30 and applies a longitudinal force simultaneously in the direction of the O-ring 24 and the bevel 26 will immediately disengage the O-ring 24.

Figure 6:
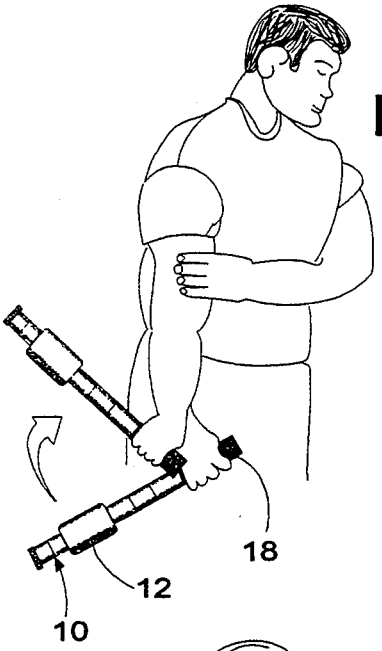
FIG. 6 is a perspective view of the invention shown in FIG. 1 in use for ulnar deviation.
Figure 7:
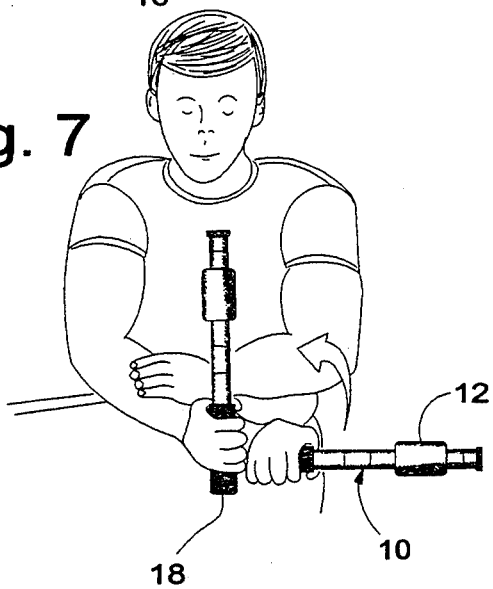
FIG. 7 is a perspective view of the invention shown in FIG. 1 in use for forearm supination.
Figure 8:
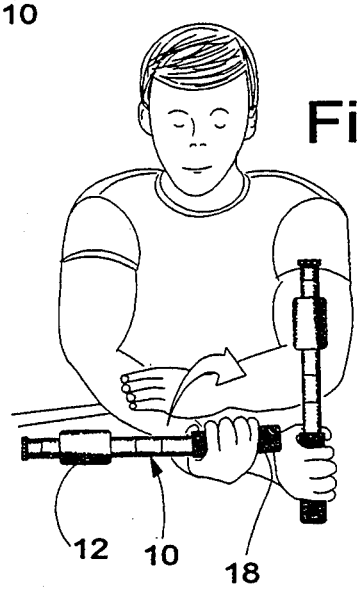
FIG. 8 is a perspective view of the invention shown in FIG. 1 in use for forearm pronation.

FIGS. 5 to 8 show some of the exercise positions and motions which the device facilitates. These are the preferred modes of using the device by grasping the gripping area. However, other more conventional exercise modes are achieved by grasping a weight 12, 28, or 30 positioned centrally on shaft 14.

While the instant invention has been shown and described herein in what are conceived to be the most practical and preferred embodiments, it is recognized that departures may be made therefrom within the scope of the invention, which is therefore not to be limited to the details disclosed herein, but is to be afforded the full scope of the claims so as to embrace any and all equivalent apparatus and articles.

What is claimed is:

1. A weight exercise device comprising:

an elongated cylindrical weight bar having a gripping area extending from one end of said bar;

a weight having a cylindrical hole longitudinally therethrough sized for sliding engagement over said weight bar;

spaced annular grooves formed in said weight bar, spacing distance between two said grooves generally equal to a length of said weight;

elastomeric stretchable O-rings sized to be releasibly secured within one said groove at each end of said weight whereby said weight is secured from longitudinal movement on said weight bar, whereby said weight is positionable along said weight bar and secured by said-O-rings at several distances between said gripping area and another end of said weight bar.

2. A weight exercise device as set forth in claim 1, wherein:

said gripping area is defined by a compressible elastomeric foam tubular sleeve secured on said weight bar.

3. A weight exercise device as set forth in claim 2, further comprising:

a stop threadably engageable onto said other end of said weight bar, said stop larger in diameter than said weight bar whereby said weight is confined on said weight bar.

4. A weight exercise device as set forth in claim 3, wherein:

said weight has a length generally equal to the distance along said weight bar between three adjacent said grooves.

5. A weight exercise device comprising:

an elongated cylindrical weight bar having a gripping area extending toward a center area of said weight bar from one end thereof;

a plurality of generally cylindrical weights each being of equal length and of a different weight size and having a longitudinal hole therethrough sized for sliding engagement over said weight bar;

spaced annular grooves formed into an outer cylindrical surface of said weight bar and extending from another end of said weight bar to said gripping area, said grooves having a spacing size generally equal to a multiple of the length of said weights;

elastomeric O-ring sized to be elastically secured within one said groove positioned at each end of said plurality of weights to prevent longitudinal movement thereof along said weight bar.

6. A weight exercise device as set forth in claim 5, wherein:

said gripping area is defined by a compressible elastomeric foam tubular sleeve secured on said weight bar.

7. A weight exercise device as set forth in claim 6, further comprising:

a stop threadably engageable onto said other end of said weight bar, said stop larger in diameter than said weight bar whereby said weights are confined on said weight bar.

8. A weight exercise device as set forth in claim 5, wherein:

each end of each said longitudinal hole being beveled to facilitate removal of each said O-rings from said grooves.

* * * * *